United States Patent [19]

Herbst et al.

[11] Patent Number: 4,867,863

[45] Date of Patent: Sep. 19, 1989

[54] RESID CATALYTIC CRACKING PROCESS UTILIZING ZSM-5 FOR INCREASED GASOLINE OCTANE

[75] Inventors: Joseph A. Herbst, Turnersville, N.J.; Albin Huss, Jr., Chadds Ford, Pa.

[73] Assignee: Mobil Oil Corporation, New York, N.Y.

[21] Appl. No.: 174,987

[22] Filed: Mar. 29, 1988

[51] Int. Cl.[4] ..... C10G 11/05

[52] U.S. Cl. ..... 208/120; 208/52 CT

[58] Field of Search ..... 208/120, 113, 52 CT; 502/67

[56] References Cited

U.S. PATENT DOCUMENTS

| | | | |
|---|---|---|---|
| 3,702,886 | 11/1972 | Argauer et al. | 423/328 |
| 3,758,403 | 9/1973 | Rosinski et al. | 208/120 |
| 3,894,931 | 7/1975 | Nace et al. | 208/73 |
| 3,894,933 | 7/1975 | Owen et al. | 208/77 |
| 3,894,934 | 7/1975 | Owen et al. | 208/78 |
| 4,309,279 | 1/1982 | Chester et al. | 208/120 |
| 4,309,280 | 1/1982 | Rosinski et al. | 208/120 |
| 4,416,765 | 11/1983 | Chester et al. | 208/120 |
| 4,442,223 | 4/1984 | Chester et al. | 502/64 |
| 4,457,833 | 7/1984 | Zandona et al. | 208/120 |
| 4,552,648 | 11/1985 | Rosinski et al. | 208/120 |

OTHER PUBLICATIONS

"ZSM-5 in FCC, Potential Impact on Refinery Operation", F. G. Dwyer, F. Gorra, and J. Herbst, Mobil Res. & Dev. Corp, Paulsboro, NJ, 1986.

"Octane Enhancementin FCC Via ZSM-5", F. G. Dwyer, P. H. Schipper, F. Gorra, Mobil Res. & Dev. Corp., Paulsboro, NJ, 1987.

*Primary Examiner*—Anthony McFarlane

*Attorney, Agent, or Firm*—Alexander J. McKillop; Charles J. Speciale; Dennis P. Santini

[57] ABSTRACT

A process for catalytically cracking deep cut vacuum gas oils, resids, or other reduced crudes containing metal contaminants to increase gasoline octane. Hydrocarbon feedstocks which include vanadium and sodium contaminants are introduced into the reaction zone of a catalytic cracking unit. Catalytic cracking catalysts which include a ZSM-5 type catalytic component are contacted in the reaction zone with the metals-containing hydrocarbon feedstock. The hydrocarbon feedstock is cracked at high temperature by the cracking catalysts, resulting in increased gasoline octane, and surprising tolerance of the ZSM-5 type catalytic component to poisoning from the usually expected synergistically destructive combination of sodium and vanadium on Y-type zeolites.

20 Claims, No Drawings

RESID CATALYTIC CRACKING PROCESS UTILIZING ZSM-5 FOR INCREASED GASOLINE OCTANE

BACKGROUND OF THE INVENTION

1. Field of the Invention

The present invention relates to a process for cracking deep cut vacuum gas oils, resids or other reduced crudes for increased gasoline octane utilizing a catalytic cracking catalyst, which includes a ZSM-5 component that said ZSM-5 component exhibits a surprising tolerance to poisoning by sodium and vanadium.

2. Background of the Related Art

Current worldwide refinery trends indicate a continuing need to process heavier feedstocks. As a result, many refineries will be processing FCC feeds containing resids or deeper cut gas oils which have high metals content. The phaseout of lead additives for gasoline in both the U.S. and in Europe will require refiners to turn to other alternatives to increase gasoline octane, including octane catalysts.

Fluid catalytic cracking (FCC) is commercially practiced in a cycling mode in which a hydrocarbon feedstock is contacted with hot, active, solid particular catalyst without added hydrogen at rather low pressures of up to about 50 PSIG at temperatures sufficient to support the desired cracking. As the hydrocarbon feed is cracked to form more valuable and desirable products, in the presence of a cracking catalyst, carbonaceous residue known as "coke" is deposited on the catalyst. The coke contains carbon as well as metals which are present in the feedstock.

In fluid catalytic cracking (FCC), the catalyst is a fine powder of about 20–200 microns in size. The fine powder is propelled upwardly through a riser reaction zone, suspended and thoroughly mixed in the hydrocarbon feed. The hydrocarbon feed is cracked at high temperatures by the catalyst and separated into various hydrocarbon products. The coked catalyst particles are separated from the cracked hydrocarbon products, and after purging, are transferred into the regenerator where the coke is burned off to regenerate the catalyst. The regenerated catalyst then flows downward from the regenerator to the base of the riser.

Deposition of coke on the catalyst particles is generally considered undesirable for two reasons: first, it inevitably results in a decline in catalytic activity to a point where the catalyst is considered to have become "spent"; and second, coke generally forms on the catalyst at the expense of the more desired liquid products. To regenerate the catalytic activity, the hydrocarbon residues of the coke must be burnt off of the "spent" catalyst at elevated temperatures in the regenerator. Unlike the hydrocarbon residues, the metallic residues such as vanadium, sodium, nickel and the like, are not removed by high temperature regeneration. Rather, the catalytic cracking catalyst must be somehow protected from the deleterious effects of metallic residues.

There are substantial economic incentives for refineries to process reduced crudes due to factors such as the price and availability of heavy fuel oil ("HFO"), coal, the demand for asphalt and a particular refiner's ability to process the 650+ through 1150+ fractions.

Reduced crudes, however, are generally high in metals which poison the cracking catalyst and therefore require a high replacement rate of the catalyst in order to maintain catalyst selectivity and activity. In recent years, extensive research efforts have been directed towards developing improved catalysts and processes for reducing the deleterious effects caused by metals when cracking resids or deep cut vacuum gas oils.

The use of ZSM-5 type zeolites, such as ZSM-5, ZSM-11 and the like are known to result in improved gasoline octane and overall yields when used in conjunction with conventional cracking catalysts in cracking gas oils. The use of ZSM-5 in cracking is disclosed in U.S. Pat. Nos. 3,702,886; 3,758,403; 3,894,931; 3,894,933; 3,894,934; 4,309,279; 4,309,280; and 4,416,765. As understood, none of these patents specifically teach the use of ZSM-5 in resid cracking. While more recent patent, U.S. Pat. No. 4,552,648 includes examples which use ZSM-5 with hydrotreated Arab Light Resid, the chargestock contained less than 1 ppm Ni and V. In addition, this patent does not address the unexpected and exceptional metals tolerance of ZSM-5 catalysts to poisoning by these metals.

The deleterious effects of metals have been mentioned extensively in the patent literature, for example U.S. Pat. Nos. 4,376,696; 4,513,093 and 4,515,900, and are well known to those skilled in the art. Vanadium substantially deactivates cracking catalysts by irreversibly destroying the active zeolite, while other metals such as nickel promote dehydrogenation reactions which result in undesirable increases in coke and hydrogen yields.

It has long been known to those in the petroleum refining art that the combination of sodium and vanadium in a crude feedstock, results in a synergistically destructive effect on the Y-containing cracking catalysts. For example, in the presence of about 0.5 wt % Na, a vanadium level of 5,000 ppm on the catalyst will have a substantially greater destructive effect on the Y-containing zeolite under hydrothermal conditions than when there is no sodium present. A priori, a similar synergistically destructive effect might also be expected by the combination of sodium and vanadium on ZSM-5 type catalysts.

It has been previously discovered that ZSM-5 type zeolites used in conjunction with conventional cracking catalysts, exhibit a high tolerance to metal poisoning by vanadium and nickel present in resids or other reduced crudes. The results of this work were disclosed at the fourth CCIC Technical Meeting, Tokyo, Japan on June 9, 1986 in a paper entitled *ZSM-5 IN FCC, POTENTIAL IMPACT ON REFINERY OPERATIONS*, by F. G. Dwyer, F. Gorra, J. Herbst, Mobil Research and Development Corporation, Paulsboro, N.J. 08066, U.S.A. Briefly, the paper disclosed the excellent tolerance of ZSM-5 to vanadium and nickel poisoning in metal-containing crudes and its resulting advantages and applications in processing resids or other reduced crudes. This publication, however, does not disclose the unexpected resistance of ZSM-5 to the synergistically destructive combination of sodium and vanadium.

Octane enhancement in FCC and the excellent metal tolerance by ZSM-5 was again the topic of a presentation at the NPRA ANNUAL MEETING held on Mar. 29–31, 1987, in San Antonio, Tex.. This presentation was published by F. G. Dwyer and P. H. Schipper of Mobil Research and Development Corporation, Paulsboro, New Jersey and F. Gorra of EniChem Anic SA, Milan, Italy, in a document entitled: *Octane Enhancement in FCC Via ZSM-5*, which is incorporated by reference herein. The document discusses the results of over 25 FCC and TCC operations in the United States and abroad, evaluating octane enhancement by ZSM-5, and contains an excellent background discussion of the use of ZMS-5 in FCC and TCC units. This document, at page 6, is the first to present results of laboratory tests conducted by the inventors herein, with ZSM-5 as an additive catalyst, poisoned by the combination of sodium and vanadium. The results of these tests, summarized in Table 7 of that document, show no change in the octane enhancing performance of the ZSM-5 catalyst.

Accordingly, the present invention sets forth a solution to a long felt need in the petroleum refining industry by providing a method for upgrading resids containing high concentrations of metals such as nickel, sodium and vanadium to increase gasoline octane by utilizing a catalytic cracking catalyst, which includes a ZSM-5 component. The ZSM-5 component of the catalyst not only exhibits surprising tolerance to metal poisoning due to nickel and vanadium, but also quite unexpectedly, exhibits tolerance to the normally synergistically destructive combination of sodium and vanadium on Y-type zeolites.

SUMMARY OF THE INVENTION

Accordingly, the present invention provides a process for catalytically cracking vacuum gas oils, resids, or other reduced crudes containing metal contaminants to increase gasoline octane. Hydrocarbon feedstocks which include vanadium and sodium contaminants are introduced into the reaction zone of a catalytic cracking unit. A catalytic cracking catalyst which includes a ZSM-5 type catalyst component is fluidized in the reaction zone in contact with the metals-containing hydrocarbon feedstock. The hydrocarbon feedstock is cracked at high temperatures by the cracking catalyst, resulting in increased gasoline octane of the hydrocarbon product, and surprising tolerance of the ZSM-5 type catalyst component to poisoning from the normally expected synergistically destructive combination of sodium and vanadium on Y-type zeolites.

In addition to the ZSM-5 type component, the cracking catalysts utilized in the process of the present invention also typically contain catalytically active cracking components having a pore size greater than about 7 angstroms. Such components include amorphous silica-alumina, and/or crystalline silicaalumina and/or large pore crystalline zeolites.

Representative crystalline zeolite constituents of these cracking catalysts include zeolite X described in U.S. Pat. 2,882,244, zeolite Y described in U.S. Pat. 3,130,007, synthetic mordenite and dealuminized synthetic mordenite, merely to name a few, as well as naturally occurring zeolites, including chabazite, faujasite, mordenite, and the like. Preferred crystalline zeolites include natural faujasite and the synthetic faujasite zeolites X and Y, with particular preference being accorded to zeolite Y. For the purposes of this invention, zeolite Y includes zeolite Y in its as-synthesized form, as well as its variant forms including framework dealuminated zeolite Y, e.g., ultrastable Y (USY) described in U.S. Pat. No. 3,293,192 and LZ-210 described in U.S. Pat. No. 4,503,023.

The hydrocarbon feedstock may also include the combination of nickel and sodium, or nickel and vanadium. Preferably, the reaction zone of a catalytic cracking unit is maintained at a temperature from about 900° F. to about 110° F. and the catalyst regenerator temperature is maintained at about 1200°–1400° F. The hydrocarbon feedstock which is introduced into the reaction zone of the catalytic cracking unit, typically contains from about 0.1 to about 25 lbs. sodium and from about 0.5 to about 250 lbs. vanadium per thousand barrels. The ZSM-5 type component of the catalytic cracking catalyst is replaced at a makeup rate of about 0.2 lbs. to about 500 lbs. ZSM-5 per thousand barrels of feedstock processed. Typically, the ZSM-5 type component is present in a range from about 0.5 to about 5% of the catalytic cracking catalyst inventory.

For a better understanding of the present invention, reference is made to the following description and examples, taken in conjunction with the accompanying tables, the scope of which is pointed out in the appended claims.

DETAILED DESCRIPTION OF THE INVENTION

In contrast to conventional cracking catalysts, the ZSM-5 type catalysts, and ZSM-5 in particular, exhibit significantly greater tolerance to metal poisoning and are therefore particularly applicable to resid upgrading processes. Especially unexpected i the tolerance of the ZSM-5 type component to poisoning from the synergistically destructive combination of sodium and vanadium which are routinely observed on Y-containing cracking catalysts. This makes ZSM-5 particularly applicable to resid type applications. As discussed in U.S. Pat. No. 4,309,279, incorporated by reference herein, there is a significant improvement in the octane number of gasoline produced by a catalytic cracking unit utilizing ZSM-5 type catalytic components. In addition, as discussed therein, there is also in increase in the total yield of the combination of $C_5+$ gasoline and alkylate produced by the catalytic cracking units and alkylation units, respectively, when ZSM-5 type catalytic cracking components are utilized.

The catalytic cracking process of the present invention generally operates with a cracking reaction zone temperature of from about 800° to about 1300° F., preferably from about 900° to about 1100° F., and with a catalyst regenerator temperature of from about 1000° to about 1800° F., preferably from about 1200° to 1400° F. The deep cut vacuum gas oil or resid feedstock contains from about 0.1 to about 25 lbs. sodium and from about 0.5 to about 250 lbs. vanadium per thousand barrels of hydrocarbon feed. The ZSM-5 type component of the catalytic cracking catalyst is replaced at a makeup rate of from about 0.2 to about 500 lbs. ZSM-5 per thousand barrels of feedstock processed. Typically, the ZSM-5 type component is present in the range from about 0.5 to about 5% of the catalytic cracking inventory. When operating within the aforementioned range of process and feed conditions, the effects of the ZSM-5 component are surprisingly pronounced. Namely, when processing a feedstock containing appreciable amounts of sodium and vanadium at these severe process conditions, very substantial deactivation of catalytic activity occurs on conventional cracking catalysts containing Y-type zeolites. The ZSM-5 type component utilized in the process of the present invention is significantly less affected at these conditions.

EXAMPLES

Examples 1A–1D

1A. A ZSM-5 additive catalyst was prepared by spray drying a mixture containing 20% ZSM-5 in an 87/13 (wt/wt) $SiO_2$-$Al_2O_3$ gel matrix. The spray dried catalyst was exchanged with a 1.0N $NH_4NO_3$ solution and was then washed with 10 cc $H_2O$/g catalyst and dried at 250° F. for about 16 hrs. The catalyst was analyzed chemically and found to contain (100% solids basis) 90.6 wt % $SiO_2$, 9.4 wt % $Al_2O_3$ and <0.01 wt % sodium.

1B. A potion of the ZSM-5 additive described in Example 1A was steamed at 1450° F for 10 hours in a 45% steam/55% air, 0 psig atmosphere. The resulting catalyst surface area was 84 $m^2$/g.

1C. A portion of the ZSM-5 additive catalyst from Example 1A was blended with an amount of $V_2O_5$ powder such that the overall vanadium content was 0.5 wt % in the mixture. This mixture was steamed at the same conditions as specified in Example 1B. The resulting catalyst had a surface area of 62 $m^2$/g and a V content of 0.53 wt % based on physical/chemical analyses.

1D. A portion of the ZSM-5 additive catalyst from Example 1A was blended with an amount of $V_2O_5$ powder such that the overall vanadium content was 1 wt % in the mixture. This mixture was steamed at the conditions specified in Example 1B. The resulting catalyst had a surface area of 46 $m^2$/g and a vanadium content of 0.77 wt % based on physical/chemical analyses.

Examples 2A–2C

Three blends, each containing 2% steamed ZSM-5 in an equilibrium REY base catalyst, were prepared by combining 10 parts by weight of steamed ZSM-5 catalysts from Examples 1B, 1C, and 1D, respectively, with 90 parts by weight of an equilibrium REY cracking catalyst. The resulting catalyst blends were designated as the catalysts of Examples 2A, 2B and 2C, respectively.

To demonstrate the effect of vanadium on ZSM-5 performance, the catalysts from Examples 2A–2C along with the equilibrium REY base catalyst were each catalytically evaluated in a fixed-fluidized bed unit at 960° F. temperature and 1.0 minutes on-stream using Joliet Sour Heavy Gas Oil (JSHGO) as feed. The JSHGO feed utilized in these evaluations has the properties shown in Table 1. The cat/oil ratio was varied from 2.5–5.0 with a corresponding WHSV range of 15–30 $hr^{-1}$ to cover a wide range of conversions. The resulting yields at 60 vol % conversion, given in Table 2, clearly demonstrate the excellent vanadium tolerance of the ZSM-5 additive catalyst. As indicated by the octane gain and yield shifts, no significant loss of ZSM-5 activity was observed even for the ZSM-5 additive catalyst containing 0.77 wt % vanadium.

TABLE 1

| Chargestock | Joliet Sour Heavy Gas Oil (JSHGO) | Arab Light Atmospheric Resid (ALAR) |
|---|---|---|
| Gravity, API | 24.3 | 20.2 |
| Aniline Pt., °F. | 171 | — |
| Hydrogen, wt. % | 12.3 | — |
| Sulfur, wt .% | 1.87 | 2.73 |
| Nitrogen, wt. % | 0.10 | — |
| Basic Nitrogen, ppm | 327 | 432 |
| Conradson Carbon, wt % | 0.28 | 6.55 |
| Kinematic Viscosity at 210° F. | 3.6 | — |
| Bromine No. | 4.2 | — |
| R.I. at 70° F. | 1.5080 | — |
| Molecular Weight | 358 | 435 |
| Pour Point, °F. | 85 | — |
| Paraffins, wt. % | 23.5 | 22.5 |
| Naphthenes, wt. % | 32.0 | 19.2 |

TABLE 1-continued

| Chargestock | Joliet Sour Heavy Gas Oil (JSHGO) | Arab Light Atmospheric Resid (ALAR) |
|---|---|---|
| Aromatics, wt. % | 44.5 | 58.2 |
| Aromatic Carbon, wt. % | 18.9 | 21.5 |
| Ni, ppm | 0.3 | 6.0 |
| V, ppm | 0.6 | 22.0 |

TABLE 2

Effect of Vanadium on ZSM-5 Performance in FCC

| | Equil. REY | +2% ZSM-5 | +2% ZSM-5 | +2% ZSM-5 |
|---|---|---|---|---|
| Example | — | 2A | 2B | 2C |
| V Content, ppm | | | | |
| Base FCC Catalyst | 950 | 950 | 950 | 950 |
| ZSM-5 Additive | — | 0 | 5300 | 7700 |
| Conversion, % vol. | 60 | 60 | 60 | 60 |
| Product Yields: | | | | |
| $C_5$+ Gasoline, % vol | 49.3 | 46.0 | 44.7 | 46.9 |
| Total $C_4$'s, % vol | 11.3 | 13.2 | 14.5 | 12.8 |
| Dry Gas, % wt | 6.6 | 8.2 | 7.9 | 7.2 |
| Coke, % wt | 3.8 | 4.0 | 3.8 | 3.9 |
| $H_2$, % wt | 0.20 | 0.19 | 0.20 | 0.23 |
| LFO, % wt | 32.8 | 32.5 | 32.6 | 32.5 |
| HFO, % wt | 9.0 | 9.5 | 9.3 | 9.4 |
| G + D, % wt | 73.3 | 69.8 | 69.4 | 71.3 |
| n-$C_4$, % vol | 0.9 | 0.9 | 1.1 | 0.9 |
| i-$C_4$, % vol | 4.1 | 4.8 | 4.9 | 4.6 |
| $C_4$=, % vol | 4.2 | 4.9 | 5.6 | 4.8 |
| $C_3$, % vol | 1.2 | 1.4 | 1.2 | 1.2 |
| $C_3$=, % vol | 6.0 | 8.6 | 8.8 | 7.3 |
| Potential Alkylate Yields: | | | | |
| Alkylate, % vol | 20.7 | 26.7 | 28.8 | 24.3 |
| $C_5$+ Gasoline + Alkylate, % vol | 70.0 | 72.7 | 73.5 | 71.2 |
| Additional i-$C_4$ Required, % vol | 9.9 | 13.4 | 14.7 | 11.9 |
| Octane, RON + O: | | | | |
| $C_5$+ Gasoline | 89.3 | 90.6 | 91.2 | 90.7 |
| $C_5$+ Gasoline + Alkylate | 90.8 | 91.9 | 92.3 | 91.9 |

As shown in Table 2, the addition of vanadium had no deleterious effect on ZSM-5 performance. The gasoline octane increased by about 1.3 RON+O due to the addition of the ZSM-5 catalyst, and was not adversely affected by the presence of up to 0.77 wt % vanadium. In addition, the total $C_4$'s and potential alkylate yields, both indicative of ZSM-5 activity, were not substantially affected by the addition of vanadium. It was also noted that the addition of vanadium had no observable effect on coke yield.

Example 3A and 3B

3A. Additive "O", commercially available ZSM-5 additive catalyst manufactured by the Davison Division of W.R. Grace, was steamed at the conditions specified in Example 1B. This catalyst contains 25% ZSM-5 (supplied by Mobil) and based on chemical analyses contains 74.0 wt % $SiO_2$, 25.4 wt % $Al_2O_3$ and 0.06 wt % Na. The surface areas of the fresh and steamed catalysts were 116 and 94 $m^2$/g, respectively.

3B. A portion of the fresh Additive "O" sample was blended with an amount of $V_2O_5$ such that the overall vanadium content was 0.5 wt % in the mixture. This mixture was steamed at the conditions specified in Example 1B. The resulting catalyst had a surface area of 63 $m^2$/g and was analyzed by atomic absorption to contain 0.55 wt % vanadium. Examples 4A and 4B Two blends, each containing 2% steamed ZSM-5 in an equilibrium REY base catalyst, were prepared by combining 8 parts by weight of steamed ZSM-5 catalysts from Examples 8 and 9, respectively, with 92 parts by weight of an equilibrium REY cracking catalyst. The resulting blends were designated as the catalysts of Examples 4A and 4B, respectively.

The catalysts of Examples 4A and 4B were evaluated along with the equilibrium REY base catalyst in a fixed-fluidized bed unit in an identical manner to that described in Examples 2A–2C. The results, given in Table 3 for 60 vol % conversion of JSHGO, demonstrate the excellent vanadium tolerance of the ZSM-5 containing Additive "O". The octane enhancement capability and yield shifts of ZSM-5 are not deleteriously effected by the presence of vanadium.

TABLE 3

Effect of Vanadium on ZSM-5 Catalyst Performance In FCC

| | Equil. REY | +2% ZSM-5 | +2% ZSM-5 |
|---|---|---|---|
| Example | — | 4A | 4B |
| V Content, ppm | | | |
| Base FCC Catalyst | 950 | 950 | 950 |
| ZSM-5 Additive | — | 0 | 5500 |
| Conversion, % vol | 60 | 60 | 60 |
| Product Yields: | | | |
| $C_5$+ Gasoline, % vol | 49.3 | 45.7 | 43.1 |
| Total $C_4$'s, % vol | 11.3 | 13.9 | 14.8 |
| Dry Gas, % wt. | 6.6 | 7.4 | 9.0 |
| Coke, % wt. | 3.8 | 3.9 | 3.9 |
| $H_2$, % wt. | 0.20 | 0.19 | 0.23 |
| LFO, % wt. | 32.8 | 32.5 | 32.4 |
| HFO, % wt. | 9.0 | 9.4 | 9.6 |
| G + D, % wt. | 73.3 | 70.3 | 68.0 |
| n-$C_4$, % vol | 0.9 | 1.0 | 0.9 |
| i-$C_4$, % vol | 4.1 | 4.9 | 4.8 |
| $C_4^=$, % vol | 6.4 | 8.1 | 9.1 |
| $C_3$, % vol | 1.2 | 1.3 | 1.2 |
| $C_3^=$, % vol | 6.0 | 7.0 | 10.4 |
| Potential Alkylate Yields: | | | |
| Alkylate, % vol | 20.7 | 26.6 | 32.4 |
| $C_5$+ Gasoline + Alkylate, % vol | 70.0 | 72.3 | 75.5 |
| Additional i-$C_4$ Required, % vol | 9.9 | 13.2 | 17.2 |
| Octane, RON + O: | | | |
| $C_5$+ Gasoline | 89.3 | 90.7 | 91.3 |
| $C_5$+ Gasoline + Alkylate | 90.8 | 91.9 | 92.5 |

As shown in Table 3, the addition of vanadium had no deleterious effect on ZSM-5 performance. The gasoline octane increased by about 1.4 RON+O due to the addition of the ZSM-5 catalyst, and was not adversely affected by the presence of up to 0.55 wt % vanadium. In addition, the total $C_4$'s and potential alkylate yields, both indicative of ZSM-5 activity, were not adversely affected by the addition of vanadium. It was also noted that the addition of vanadium had no observable effect on coke yield.

The foregoing Examples 1–4 illustrated the excellent vanadium tolerance of ZSM-5. Examples 5 and 6 which follow, are included to compare the vanadium tolerance of a commercial REY catalyst to the vanadium tolerance of the ZSM-5 catalysts.

Examples 5A and 5B

5A. The commercial REY catalyst used in this study, Super D, was manufactured by the Davision Division of W.R. Grace. This catalyst was chemically analyzed and found to obtain (100% solids basis) 63.7 wt % $SiO_2$, 32.3 wt % $Al_2O_3$, 3.0 wt % $RE_2O_3$ and 0.57 wt % Na. X-ray analysis indicates an REY content of about 14 wt %. The surface area of the as-received catalyst was 151 $m^2/g$.

5B. The commercial REY catalyst of Example 5A was steamed at the conditions specified in Example 1B. The resulting surface area was 114 $m^2/g$.

Example 6A–6C

Three portions of the catalyst from Example 5A were each blended with an amount of $V_2O_5$ such that the overall vanadium contents in the mixtures were 0.2, 0.5 and 0.75 wt % V, respectively. The three resulting mixtures were individually steamed at the same conditions as specified in Example 1B. The resulting catalysts (designated Examples 6A–6C) contained, based on atomic absorption analyses, 0.23, 0.52 and 0.84 wt % V, respectively with corresponding surface areas of 75, 31 and 22 $m^2/g$.

To determine the effect of the vanadium on the commercial REY catalyst, the catalysts from Examples 5B and 6A–6C were evaluated in a fixed-fluidized bed unit at 960° F. temperature, 3.0 cat/oil (15 WHSV), 1.0 minute on-stream using the JSHGO chargestock described in Table 1. The results are summarized in Table 4.

TABLE 4

Vanadium Deactivation of a Commercial REY Catalyst
Catalysts Stmd: 1450° F., 10 hours, 45/55 Steam/Air

| Example | 5B | 6A | 6B | 6C |
|---|---|---|---|---|
| V on Catalyst, ppm | 0 | 2300 | 5200 | 8400 |
| Conversion at 3 cat/oil, % vol | 70.3 | 62.4 | 30.8 | 25.7 |
| Surface Area, $m^2/g$ | 114 | 75 | 31 | 22 |
| % REY by X-ray | 11 | 8 | 2 | 2 |

In contrast to the excellent vanadium tolerance of ZSM-5, the results for the REY catalyst, shown in Table 4, indicate a dramatic loss of cracking activity even at 2300 ppm V. At greater than 5000 ppm V the conversion, surface area and X-ray crystallinity data indicate essentially complete destruction of the REY.

Examples 7A–7G show the effects of the addition of Ni to both commercial FCC and ZSM-5 additive catalysts. The results of Examples 7 and 8, which follow, indicate that ZSM-5 is substantially less affected by the addition of Ni than conventional REY catalysts, based upon both hydrogen factor and coke yield.

Example 7

7A. The base catalyst used in this part of the study, MRZ-204S, was manufactured by Catalysts and Chemicals Industries Co., LTD. (CCIC) of Japan. This catalyst was steam deactivated by the procedure specified in Example 1B. The resulting catalyst was designated as the catalyst of Example 7A. The surface areas of the fresh and steamed catalysts are 187 and 121 $m^2/g$, respectively. Based on chemical analyses, this catalyst contains (100% solids basis) 60.2 wt % $SiO_2$, 37.7 wt % $Al_2O_3$, 0.52 wt % $RE_2O_3$ and 0.10 wt % Na.

7B. MC-7, a ZSM-5 additive catalyst prepared by CCIC, was steamed at the conditions specified in Example 1B. The resulting catalyst was designated as the catalyst of Example 7B. This catalyst contains 25% ZSM-5 (supplied by Mobil) and based on chemical analyses contains (100% solids basis) 72.0 wt % $SiO_2$, 27.5 wt % $Al_2O_3$ and 0.03 wt % Na. The surface areas of the fresh and steamed catalysts were 153 and 92 $M^2/g$, respectively.

in an identical manner to that described in Examples 2A–2C. The results are summarized in Table 5 for 50 vol % conversion of JSHGO.

TABLE 5

Effect of 2000 ppm Ni on ZSM-5 Additive and FCC Base Catalysts at 50 Vol % Conversion of JSHGO.

| | Base FCC Catalyst | +2% ZSM-5 | | | | |
|---|---|---|---|---|---|---|
| Example | 7A | 7E | 7F | 7G | 8A | 8B |
| Ni Content, ppm | | | | | | |
| Base FCC Catalyst | 0 | 0 | 0 | 2000 | 0 | 2000 |
| ZSM-5 Additive | — | 0 | 2000 | 2000 | 2000 | 2000 |
| Product Yields: | | | | | | |
| $C_5$+ Gasoline, % vol | 42.0 | 38.9 | 36.8 | 30.3 | 36.5 | 32.5 |
| Total $C_4$'s, % vol | 9.4 | 11.3 | 12.2 | 10.5 | 12.3 | 11.6 |
| Dry Gas, % wt | 5.6 | 6.8 | 7.5 | 7.5 | 7.4 | 7.5 |
| Coke, % wt | 2.4 | 2.6 | 2.7 | 8.8 | 2.7 | 6.2 |
| $H_2$, % wt | 0.14 | 0.16 | 0.16 | 0.94 | 0.19 | 0.69 |
| LFO, % wt | 36.5 | 37.2 | 38.1 | 37.2 | 37.9 | 38.2 |
| HFO, % wt | 14.8 | 14.2 | 13.6 | 14.5 | 13.6 | 13.8 |
| G + D, % wt | 71.0 | 69.0 | 68.4 | 62.4 | 68.2 | 64.4 |
| n-$C_4$, % vol | 0.8 | 0.8 | 0.5 | 0.3 | 0.8 | 1.1 |
| i-$C_4$, % vol | 3.0 | 3.5 | 4.3 | 2.9 | 3.7 | 2.1 |
| $C_4^=$, % vol | 5.7 | 7.0 | 7.4 | 7.3 | 7.8 | 8.4 |
| $C_3$, % vol | 1.2 | 1.4 | 1.6 | 1.1 | 1.3 | 0.7 |
| $C_3^=$, % vol | 5.2 | 7.1 | 8.0 | 7.8 | 8.1 | 7.1 |
| RON + O, $C_5$+ Gasoline | 89.9 | 91.1 | 91.7 | 93.5 | 91.5 | 92.5 |
| ΔRON + O | — | 1.2 | 1.8 | 3.6 | 1.6 | 2.6 |
| $\Delta C_5$+ Gasoline, % vol | — | −3.1 | −5.2 | −11.7 | −5.5 | −9.5 |
| ΔCoke, % wt | — | 0.2 | 0.3 | 6.4 | 0.3 | 3.8 |
| Hydrogen Factor $(H_2/C_1 + C_2 + C_2^=)) \times 100$ | 138 | 158 | 157 | 989 | 173 | 564 |

Examples 7C and 7D

The catalysts of Examples 7A and 7B were impregnated at ambient temperature with a Wide-Cut Mid-Continental Gas Oil (WCMCGO) chargestock containing about 10,000 ppm Ni as naphthenate diluted with xylene to a total volume sufficient to just fill the catalyst pores. The ratio of catalyst-to-chargestock was 5 wt/wt.; the impregnated catalysts each contained about 2000 ppm Ni. After evaporation of the xylene at 250° F., the impregnated samples were heated to 980° F. in a stream of nitrogen in a fixed-fluidized bed, then held at 980° F. for 10 minutes, allowing the impregnated chargestock to crack and deposit the metals and coke on the catalyst. The coke was then removed by combustion in air at 1200° F. The resulting catalysts were designated as the catalysts of Examples 7C and 7D, respectively.

7E. A blend which contained 2% ZSM-5 in the base FCC catalyst was prepared by combining 8 parts by weight of the catalyst from Example 7B with 92 parts by weight of the catalyst from Example 7A.

7F. A blend which contained 2% Ni-impregnated ZSM-5 in the base FCC catalyst was prepared by combining 8 parts by weight of the catalyst from Example 7D with 92 parts by weight of the catalyst from Example 7A.

7G. A blend which contained 2% Ni-impregnated ZSM-5 in the Ni-impregnated base FCC catalyst was prepared by combining 8 parts by weight of the catalyst from Example 7D with 92 parts by weight of the catalyst from Example 7C.

Examples 8A and 8B

A portion of the Ni-containing catalyst blends from Examples 7F and 7G were each steamed at 1250° F. for 4 hrs in 100% steam and 0 psig atmosphere. The resulting catalysts were designated as the catalysts of Examples 8A and 8B, respectively.

The catalysts of Examples 7A, 7E–7G and Examples 8A and 8B were evaluated in a fixed-fluidized bed unit These results, shown in Table 5, demonstrate that 2000 ppm Ni on the ZSM-5 additive caused only slight increases in the dehydrogenation activity as measured by the hydrogen factor and coke yields. In contrast, the addition of 2000 ppm Ni to the base FCC catalyst dramatically increased both the hydrogen factor and coke yields, even following a 1250° F. steaming of the Ni-containing catalyst (Example 8B).

It is well known to those skilled in the art that the destructive effect of vanadium of Zeolite-Y containing cracking catalysts is substantially enhanced by the presence of high sodium levels. In order to determine the effects of added vanadium and/or sodium on the performance of ZSM-5 catalysts, the following Examples 9A–9C were carried out.

Examples 9A–9C

9A. A portion of the ZSM-5 additive catalyst from Example 1A was impregnated with sufficient $NaNO_3$ solution to produce a catalyst containing 5000 ppm sodium. The resulting catalyst was dried at 110 ° C. and subsequently steamed at the same conditions under the conditions specified in Example 1B. Ten parts by weight of this steamed ZSM-5 catalyst was then combined with 90 parts of an equilibrium REY cracking catalyst to yield a blend containing 2% steamed ZSM-5 in the equilibrium REY based catalyst.

9B. A portion of the fresh ZSM-5 additive catalyst from Example 1A was blended with an amount of $V_2O_5$ such that the overall vanadium content in the mixture was 10,000 ppm. This mixture was then steamed under the conditions specified in Example 1B. Ten parts by weight of this steamed ZSM-5 catalyst was then combined with 90 parts of an equilibrium REY cracking catalyst to yield a blend containing 2% steamed ZSM-5 in the equilibrium REY based cracking catalyst.

9C. A portion of the fresh ZSM-5 additive catalyst from Example 1A was impregnated with sufficient $NaNO_3$ solution to produce a catalyst containing 5,000 ppm sodium. This catalyst was then dried at 110 ° C. and blended with an amount of $V_2O_5$such that the overall vanadium content in the mixture was 10,000 ppm. This mixture was then steamed under the conditions specified in Example 1B. Ten parts by weight of this steamed ZSM-5 catalyst was then combined with 90 parts of an equilibrium REY cracking catalyst to yield a blend containing 2% steamed ZSM-5 in the equilibrium REY based cracking catalyst.

The catalysts of Examples 9A–9C were evaluated in a fixed-fluidized bed unit in an identical manner to that described in Examples 2A–2C. The results for 60 Volume % conversion of JSHGO are given in Table 6 along with those for both the equilibrium REY based catalyst and the catalyst of Example 2A.

TABLE 6

SODIUM AND VANADIUM EFFECT ON ZSM-5 FCC ADDITIVE CATALYST

| | Equil. REY | +2% ZSM-5 | +2% ZSM-5 | +2% ZSM-5 | +2% ZSM-5 |
|---|---|---|---|---|---|
| Example | — | 2A | 9A | 9B | 9C |
| Sodium, ppm | 5,000 | 100 | 5,000 | 100 | 5,000 |
| Vanadium, ppm | 950 | 0 | 0 | 10,000 | 10,000 |
| 60 Vol % Conversion | Base | Δ | Δ | Δ | Δ |
| $C_5$+ Gasoline, Vol % | 49.3 | −3.3 | −3.7 | −2.4 | −3.1 |
| RON + O | 89.3 | +1.3 | +1.5 | +1.4 | +1.5 |
| G + D, Vol % | 82.1 | −3.6 | −4.0 | −2.7 | −2.9 |
| $C_3^=$ + $C_4^=$ + i-$C_4$, Vol % | 16.5 | +4.0 | +4.9 | +2.7 | +3.1 |

The results, as shown in Table 6, clearly demonstrate that ZSM-5, is highly resistant to deactivation by sodium, vanadium and the normally expected synergistically destructive combination of sodium and vanadium. Even after the addition of 10,000 ppm vanadium and/or 5,000 ppm sodium, the performance of the ZSM-5 containing catalyst was shown to be comparable to the performance of a ZSM-5 containing catalyst with no added sodium and/or vanadium based upon measurement of octane gain (RON+O).

Thus far all the examples have been with a JSHGO feed. Examples 10A and 10B were performed to demonstrate the capability of ZSM-5 to enhance gasoline octane and increase the $C_3=+C_4=$yields when cracking Arab Light Atmospheric Resid (ALAR).

Examples 10A and 10B

10A. The base FCC catalyst used in this Example was obtained by steaming Super D, described in Example 5A, at 1400° F. for 4 hrs in 100% steam and 0 psig atmosphere.

10B. The ZSM-5 additive was prepared by spray drying a mixture containing 25% ZSM-5 in a freshly prepared silica-alumina-clay matrix. The silica-alumina-clay matrix was base exchanged with a solution of $(NH_4)_2SO_4$ followed by $RECl_3$exchange prior to addition of the ZSM-5. Chemical analyses results for the spray dried catalyst indicate 72.7 wt % $SiO_2$, 12.1 wt % $Al_2O_3$ and 0.01 wt % Na. This catalyst was then thermally treated at 1200° F. for 0.5 hrs in flowing $N_2$ at 0 psig and combined with the steamed Super D of Example 10A in proportions to give a catalyst belnd containing 0.25 wt % ZSM-5. The resulting blend was designated the catalyst of Example 10B.

Both the base Super D catalyst of Example 10A and the ZSM-5 containing catalyst blend of Example 10B were evaluated in a fixed-fluidized bed unit at the conditions specified in Examples 2A–2C. A series of runs was made with each catalyst using both the JSHGO and the ALAR chargestocks. The results for 72 vol % conversion of the hydrocarbon chargestocks JSHGO and ALAR, respectively, are shown in Table 7.

TABLE 7

Comparison of ZSM-5 Performance With JSHGO And Arab Light Atmospheric Resid Chargestocks

| | JSHGO | | ALAR | |
|---|---|---|---|---|
| Chargestock | REY Base | +.25% ZSM-5 | REY Base | +.25% ZSM-5 |
| Example | 10A | 10B | 10A | 10B |
| Conversion, % vol. | 72 | 72 | 72 | 72 |
| Product Yields: | | | | |
| $C_5$+ Gasoline, % vol | 55.9 | 50.9 | 44.7 | 41.9 |
| Total $C_4$'s, % vol | 16.7 | 19.5 | 21.8 | 23.2 |
| Dry Gas, % wt | 8.5 | 10.5 | 9.9 | 11.2 |
| Coke, % wt | 3.7 | 4.1 | 10.7 | 10.6 |
| n-$C_4$, % vol | 1.8 | 1.7 | 2.7 | 2.6 |
| i-$C_4$, % vol | 8.5 | 10.0 | 11.6 | 12.8 |
| $C_4^=$, % vol | 6.4 | 7.7 | 7.5 | 7.8 |
| $C_3$, % vol | 3.2 | 3.6 | 4.4 | 5.0 |
| $C_3^=$, % vol | 7.0 | 10.0 | 7.6 | 9.1 |
| Potential Alkylate Yields: | | | | |
| Alkylate, % vol | 22.4 | 29.5 | 25.1 | 28.2 |
| $C_5$+ Gasoline + Alkylate, % vol | 78.3 | 80.4 | 69.8 | 70.1 |
| Additional i-$C_4$ Required, % vol | 6.8 | 10.2 | 5.6 | 6.6 |
| Octane, RON + O: | | | | |
| $C_5$+ Gasoline | 88.7 | 91.4 | 89.0 | 90.5 |
| $C_5$+ Gasoline + Alkylate | 90.2 | 92.3 | 90.8 | 91.9 |

The results summarized in TAble 7, show significant octane gains and yield shifts due to ZSM-5 addition with both the atmospheric resid (ALAR) and conventional gas oil (JSHGO) feeds. Therefore, the excellent metals tolerance of ZSM-5 and its capability to enhance gasoline octane when cracking resid make it an ideal octane catalyst for processing reduced crudes.

Thus, while there have been described what are presently the preferred embodiments of the present invention, other and further changes and modifications could be made thereto without departing from the scope of the invention, and it is intended to claim all such changes and modifications.

We claim:

1. A process for catalytically cracking deep cut vacuum gas oils and reduced crudes containing metal contaminants to increase gasoline octane, comprising:

(a) introducing a hydrocarbon feedstock which contains vanadium and sodium contaminants into a reaction zone of a catalytic cracking unit; and, (b) contacting the hydrocarbon feedstock with a catalytic cracking catalyst, which includes a zeolite component having the structure of ZSM-5, whereby the hydrocarbon feedstock is cracked in the reaction zone of said catalytic cracking unit resulting in increased gasoline octane of the hydrocarbon products with increased tolerance of the zeolite component having the structure of ZSM-5 to poisoning by sodium and vanadium.

2. The process recited in claim 1, wherein said hydrocarbon feedstock further contains nickel.

3. The process recited in claim 2, wherein said hydrocarbon feedstock contains from about 0.2 lbs. to about 100 lbs. nickel and from about 0.1 lbs. to about 25 lbs. sodium per 1000 barrels of the hydrocarbon feedstock.

4. The process recited in claim 2, wherein said hydrocarbon feedstock contains from about 0.2 lbs. to about 100 lbs. nickel and from about 0.5 lbs. to about 250 lbs. vanadium per 1000 barrels of the hydrocarbon feedstock.

5. The process recited in claim 1, wherein said hydrocarbon feedstock contains up to about 250 ppm sodium.

6. The process recited in claim 1, wherein said hydrocarbon feedstock contains up to about 1000 ppm vanadium.

7. The process recited in claim 3, wherein said hydrocarbon feedstock further contains from about 0.5 lbs to about 250 lbs. vanadium per 1000 barrels of the hydrocarbon feedstock.

8. The process recited in claim 1, wherein the reaction zone of said catalytic cracking unit is maintained at a temperature from about 800° F. to about 1200° F.

9. The process recited in claim 1, wherein the reaction zone of said catalytic cracking unit it maintained at a temperature from about 900° F. to about 110° F.

10. The process recited in claim 1, wherein the regeneration zone of said catalytic cracking unit is maintained at a temperature from about 1000° F. to about 1800° F.

11. The process recited in claim 1, wherein the regeneration zone of said catalytic cracking unit is maintained at a temperature from about 1200° F. to about 1400° F.

12. The process recited in claim 1, wherein said hydrocarbon feedstock contains from about 0.1 to about 25 lbs. sodium, per thousand barrels of feedstock, introduced into the reaction zone of said catalytic cracking unit; and, said component having the structure of ZSM-5 zeolite is replaced at a makeup rate of from about 0.2 lbs. to about 500 lbs. per thousand barrels of feedstock processed.

13. The process recited in claim 1, wherein said hydrocarbon feedstock contains from about 0.5 lb. to about 250 lbs. vanadium, per thousand barrels of feedstock, introduced into the reaction zone of said catalytic cracking unit; and said zeolite component having the structure of ZSM-5 is replaced at a makeup rate of from about 0.2 lb. to about 500 lbs. per thousand barrels of feedstock processed.

14. The process recited in claim 12, wherein said hydrocarbon feedstock further contains from about 0.5 lb. to 250 lbs. vanadium, per thousand barrels of feedstock introduced into the reaction zone of said catalytic cracking unit.

15. The process recited in claim 14, wherein said catalytic cracking catalyst includes from about 0.5 to about 5% of the zeolite component having the structure of ZSM-5.

16. The process recited in claim 1, wherein the said catalytic cracking unit includes a fluid catalytic cracking unit.

17. The process recited in claim 1, wherein said catalytic cracking unit includes a moving bed cracking unit.

18. The process recited in claim 1, wherein said catalytic cracking catalyst contains a catalytically active cracking component selected from the group consisting of amorphous silica-alumina, crystalline silica-alimina and a large pore crystalline zeolite.

19. The process recited in claim 18, wherein said large pore crystalline zeolite is selected from the group consisting of zeolite X and zeolite Y.

20. The process recited in claim 19, wherein said large pore crystalline zeolite includes zeolite Y.

* * * * *

UNITED STATES PATENT AND TRADEMARK OFFICE

CERTIFICATE OF CORRECTION

PATENT NO. : 4,867,863

DATED : September 19, 1989

INVENTOR(S) : J.A. Herbst et al.

It is certified that error appears in the above-identified patent and that said Letters Patent is hereby corrected as shown below:

| | |
|---|---|
| Col. 4, line 23 | "i" should be --is-- |
| Col. 4, line 33 | "in" (first instance) should be --an-- |
| Col. 6, line 68 | move "Examples 4A and 4B" to top of col. 7 as line 1 heading for col. 7 |
| Col. 11, line 57 | insert a space between "$RECl_3$" and "exchange" |
| Col. 13, claim 8, line 29 | "1200°F" should be "1300°F-- |
| Col. 13, claim 9, line 31 | "it" should be --is-- |
| Col. 13, claim 9, line 32 | "110°F" should be --1100°F-- |
| Col. 14, claim 12, line 3 | insert --zeolite-- after "said" |
| Col. 14, claim 18, line 34 | "silica-alimina" should be --silica-alumina-- |

Signed and Sealed this

Thirtieth Day of October, 1990

*Attest:*

HARRY F. MANBECK, JR.

*Attesting Officer*

*Commissioner of Patents and Trademarks*